US007832106B2

(12) United States Patent
Drake

(10) Patent No.: US 7,832,106 B2
(45) Date of Patent: Nov. 16, 2010

(54) APPARATUS FOR CUTTING A CANDLE

(75) Inventor: Berlando Drake, North Hollywood, CA (US)

(73) Assignee: ATI Technologies ULC, Markham, Ontario (CA)

( * ) Notice: Subject to any disclaimer, the term of this patent is extended or adjusted under 35 U.S.C. 154(b) by 357 days.

(21) Appl. No.: 11/614,219

(22) Filed: Dec. 21, 2006

(65) Prior Publication Data

US 2008/0148577 A1 Jun. 26, 2008

(51) Int. Cl.
*B26B 3/00* (2006.01)

(52) U.S. Cl. ..... 30/282; 30/92; 30/96; 30/112; 30/114

(58) Field of Classification Search ..... 30/96, 30/112, 113, 114, 115, 116, 279.4, 92, 282; 83/453, 454, 455, 574, 761, 762; 99/538
See application file for complete search history.

(56) References Cited

U.S. PATENT DOCUMENTS

| | | | | | |
|---|---|---|---|---|---|
| 153,783 | A | * | 8/1874 | Richards | 30/115 |
| 447,615 | A | * | 3/1891 | Lewis | 206/241 |
| D85,385 | S | * | 10/1931 | Lowitz | D7/673 |
| 2,906,020 | A | * | 9/1959 | Welsh | 30/114 |
| 3,150,447 | A | * | 9/1964 | Gill | 30/96 |
| 3,869,794 | A | | 3/1975 | Smith | |
| 4,187,865 | A | * | 2/1980 | Burton | 131/250 |
| 4,300,424 | A | | 11/1981 | Flinn et al. | |
| 4,516,458 | A | * | 5/1985 | Pomerantz et al. | 83/651.1 |
| 4,589,206 | A | * | 5/1986 | Marcoux | 30/114 |
| 5,499,578 | A | * | 3/1996 | Payne | 99/537 |
| 5,621,972 | A | * | 4/1997 | Sala | 30/116 |
| 5,632,615 | A | | 5/1997 | DeGarmo | |
| 5,662,033 | A | * | 9/1997 | Yawman | 99/538 |
| 5,774,995 | A | | 7/1998 | Ross | |
| D422,470 | S | | 4/2000 | Mosca et al. | |
| 6,076,262 | A | | 6/2000 | Pappas | |
| 6,295,991 | B1 | * | 10/2001 | Emery | 131/250 |
| 6,321,453 | B1 | | 11/2001 | Pappas | |
| D454,291 | S | | 3/2002 | Mosca | |
| 6,370,779 | B1 | | 4/2002 | Pappas | |
| D464,243 | S | | 10/2002 | Mosca | |
| 6,527,545 | B2 | * | 3/2003 | Cook | 431/253 |
| 6,546,630 | B2 | * | 4/2003 | Davison | 30/92 |
| 6,711,821 | B1 | | 3/2004 | Clarke | |
| 6,964,563 | B1 | | 11/2005 | Millcevich | |
| 7,065,880 | B2 | * | 6/2006 | Howman et al. | 30/114 |
| 7,191,691 | B2 | * | 3/2007 | Kaposi | 83/167 |
| 7,249,550 | B1 | * | 7/2007 | Thune, Jr. | 83/599 |

(Continued)

*Primary Examiner*—Hwei-Siu C Payer
(74) *Attorney, Agent, or Firm*—Vedder Price P.C.

(57) ABSTRACT

A candle cutter may include a case having an outer surface and in inner surface, which may form an inner cavity. The outer surface may have one or more outer surface slots and the inner surface may have one or more inner surface slots. The candle cutter may further include a cutting assembly that meshes with the case and moves through the inner cavity for the purpose of cutting the object therein, such as a candle. The movement may be pivotal if the cutting assembly is attached to a pivot point. The movement of the cutting assembly may not be pivotal. For example, it may be controlled by guide means, such as guide rods. Some embodiments may include features such a clamping mechanism, a case handle, a locking mechanism, a bottom container, handles or knobs, and/or a detachable blade.

4 Claims, 4 Drawing Sheets

U.S. PATENT DOCUMENTS

2002/0100173 A1* 8/2002 Suer et al. ..... 30/114
2004/0111894 A1 6/2004 Bousada
2005/0262709 A1 12/2005 Polk
2006/0081585 A1 4/2006 Pierce
2006/0160041 A1 7/2006 Falle
2008/0148577 A1* 6/2008 Drake ..... 30/282
2008/0168660 A1* 7/2008 Chiu ..... 30/114

* cited by examiner

APPARATUS FOR CUTTING A CANDLE

FIELD OF THE DISCLOSURE

BACKGROUND

Candle enthusiasts often enjoy burning candles in their homes and offices. Candle enthusiasts, and others, appreciate both the lighting effects that candles can provide as well as the aromas that candles often produce. Candle burning, however, does have its problems. With some candles, for example, a candle that burns for an extended period of time becomes sunken in the middle and develops "walls" around the perimeter. This effect is particularly prevalent in candles with larger diameters. As these walls develop, the desired effects associated with candles can diminish. For example, the light (mood light) diminishes because the burning flame is now in the crater of the candle, perhaps several inches below the top of the candle. Furthermore, these walls can inhibit the candle aroma from spreading throughout a room. As yet another problem, these candle walls make it difficult to relight the candle, which may be not only frustrating when relighting candles but may also cause a candle enthusiasts to burn him or herself while attempting to relight a candle. Therefore, a need exists to, among other things, safely address these problems so that candle enthusiasts may more safely and fully enjoy burning candles.

SUMMARY

A candle cutter has a case with an outer surface and inner surface that defines an inner cavity. The outer surface may have one or more outer surface slots, and the inner surface may have one or more inner surface slots. Furthermore, a cutting assembly may mesh with the case, moving so as to pass through the one or more outer surface slots and the one or more inner surface slots, thereby passing through the inner cavity for the purpose of cutting an object, such as a candle.

The candle cutter may include a pivot point attached to the cutting assembly and also to the case, which may allow the cutting assembly to move pivotally.

In another embodiment, a candle cutter may have guide means that allow a cutting assembly to move longitudinally such that the cutting assembly passes through one or more outer surfaces and passes through one or more inner surfaces to cut an object, such as a candle.

As yet another alternative, the candle cutter may have one or more guide rods attached to the case. The cutting assembly may have guide holes, which slidably interact with the guide rods so that the cutting assembly can move longitudinally.

Other embodiments may include features such as a clamping mechanism, a case handle, a detachable blade, a locking mechanism to limit movement of a cutting assembly, or a bottom container mounted to the case for collecting candle was or other debris.

DETAILED DESCRIPTION

The present apparatus generally relates to a candle cutter. The following detailed description is of example embodiments of the presently claimed apparatus with references to the accompanying drawings. Such description is intended to be illustrative and not limiting with respect to the scope of the present apparatus. Such embodiments are described in sufficient detail to enable one of ordinary skill in the art to practice the subject apparatus, and it will be understood that other embodiments may be practiced without departing from the spirit and scope of the embodiments described herein.

Figure 1:
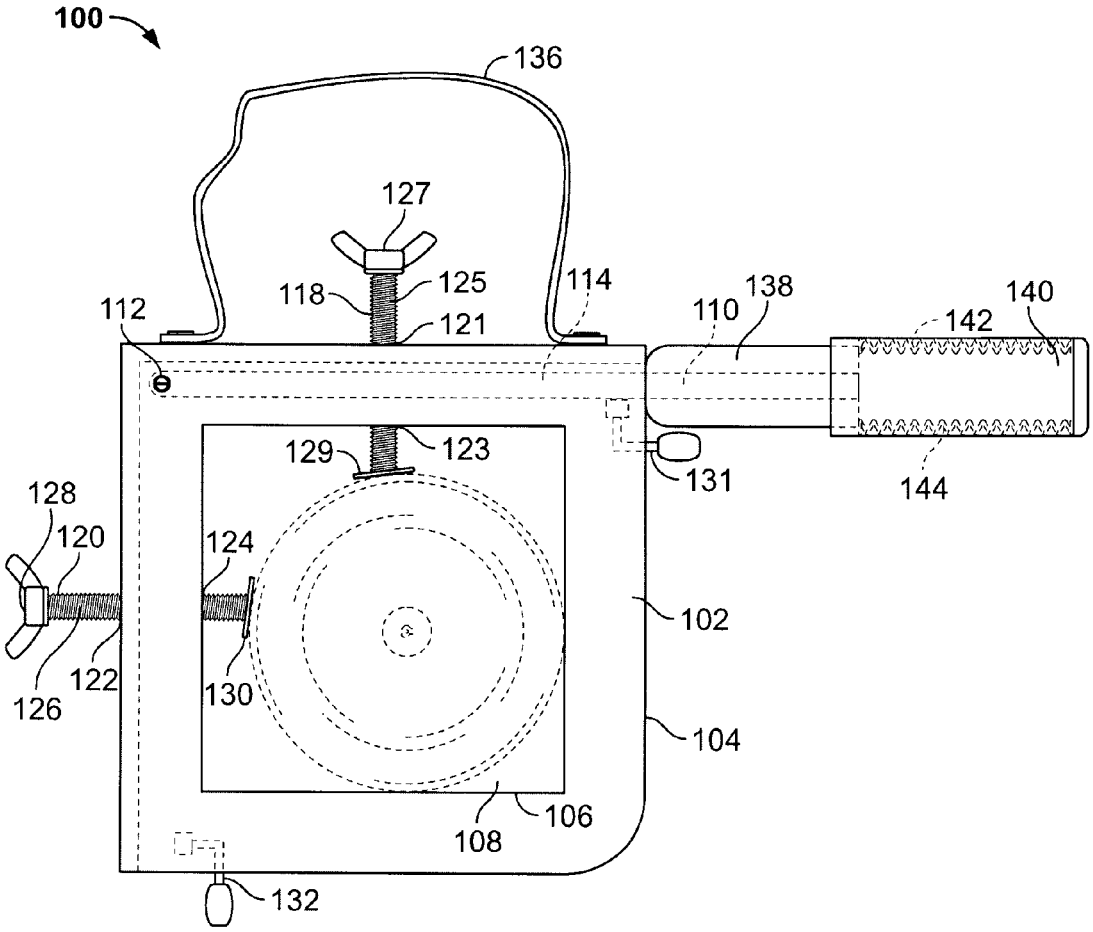
FIG. 1 shows a view of one embodiment of a candle cutter having a pivoting cutting assembly.

FIG. 1 shows a view of one embodiment of a candle cutter 100. In this embodiment, a case 102 has an outer surface 104 and forms an inner surface 106, which defines an inner cavity 108. The case 102 may be made of any suitable material. For example, case 102 may be made out of metal, plastic, rubber, wood, any other suitable material as known and used by one skilled in the art, or any combination thereof. More particularly, one may desire to make the case 102, as well as any other components, out of a flame resistant material, such as a flame resistant or flame retardant plastic. Furthermore, the case 102 may not be entirely enclosed as it is shown in FIG. 1. Instead, for example, the case 102 may be a hollow frame such that only minimal material is used to make the apparatus minimally functional. Although the illustrated embodiments show the outer surfaces forming a relatively square shape, the outer surfaces could form any other shape as a matter of design choice, such as a circle or a triangle.

Figure 2:
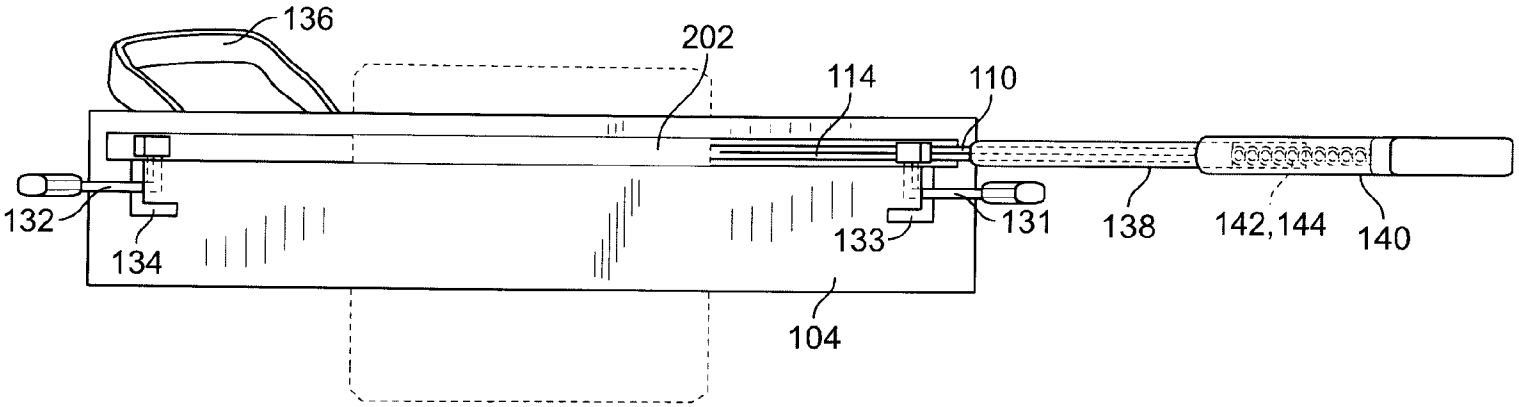
FIG. 2 shows a top and right view of the embodiment of the candle cutter shown in FIG. 1.
Figure 5:
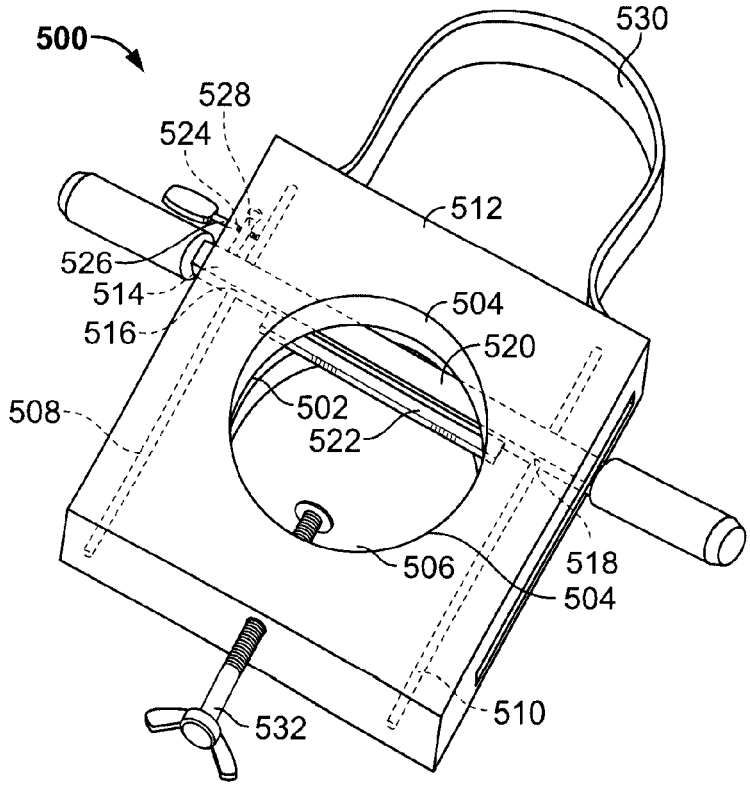
FIG. 5 shows an embodiment of a candle cutter having a cutting assembly that moves longitudinally along guide rods.
Figure 6:
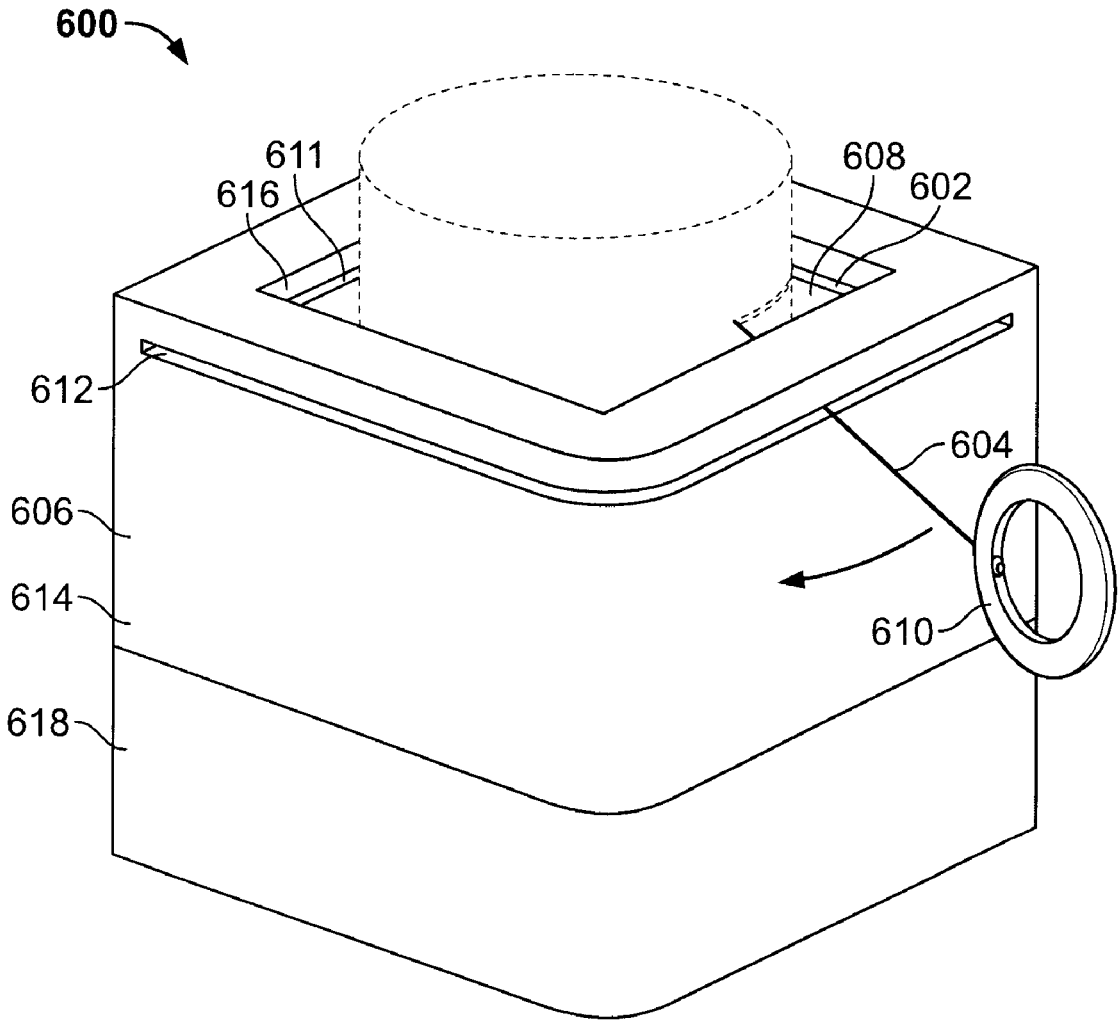
FIG. 6 shows an embodiment of a candle cutter having a string, wire, or other similar element for the blade and also includes a bottom container.

The outer surface 104 may have one or more outer surface slots 202 depicted in FIG. 2 and the inner surface 106 may have one or more inner surface slots (not shown in drawings of this embodiment but similar to inner surface slots 502 shown in the embodiment depicted in FIG. 5 or the inner surface slots 602 depicted in the embodiment depicted in FIG. 6). As one skilled in the art will appreciate, both the inner and outer slots may be of any suitable width, and the chosen width may be dependent upon manufacturing considerations, design choice, functionality, or any other consideration. For example, FIG. 1 illustrates a cutting assembly 100 that moves pivotally about pivot point 112. However, as best shown in FIG. 5, the inner and outer slots may alternatively allow a cutting assembly 110 to longitudinally move through the inner (similar to 502 or 602) and outer 202 surface slots. Thus, the slots must be minimally wide enough to allow such longitudinal movement. Such longitudinal movement is more specifically a cutting direction as one will readily recognize is required for the apparatus to function for its intended purpose Alternatively, the slots may be much wider than required to allow longitudinal movement by the cutting assembly. As one skilled in the art will appreciate, the slots may even be defined by the top and bottom surface of the case or by a frame. In such an embodiment, there would essentially be no outer surface slots or inner surface slots.

Figure 4:
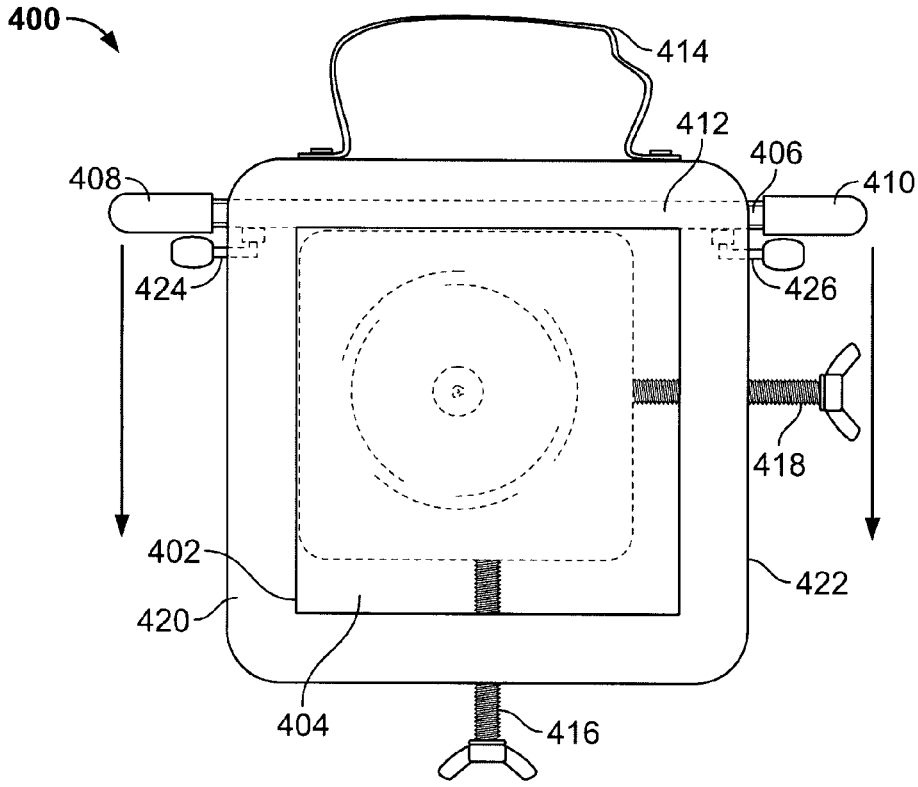
FIG. 4 shows an embodiment of a candle cutter having a longitudinally moving cutting assembly.

The perimeter of the inner surface 106 defining the inner cavity 108 may take one of any number of shapes, which may depend upon factors such as desired use or manufacturing considerations. For example, if one desires to use the candle cutter primarily for cutting cylindrical candles, the inner surface 106 may define a circular inner cavity 108. For example, FIG. 5 illustrates one embodiment having an inner surface 504 that defines a circular inner cavity 506. Somewhat similarly, as shown in FIG. 4, if a user desires to use the candle cutter primarily for cutting candles with a square or rectangular outer perimeter, the inner surface 402 may define a square or rectangular inner cavity 404. The perimeter of the inner surface, such as inner surface 106, may be continuous in nature, it may be defined by inner surfaces not fully enclosing the inner cavity, or it may even be defined by the minimal number of inner surfaces, such as two, needed to make the apparatus functional for cutting candles. As one skilled in the art will also recognize and appreciate, different embodiments may have an inner cavity with different sizes, which may be determined, in part, upon the size of the candles the user wishes to cut. Furthermore, it is understood that it is not required for the inner cavity 108 to be formed in the same shape as the candle that one desires to cut. For example, a circular candle is shown in FIG. 1, yet the inner cavity 108 is formed as a square or a rectangle.

As also shown in FIG. 1, a cutting assembly 110 may mesh with the case 102 for the purpose of cutting a candle. As one skilled in the art will appreciate, the cutting assembly 110 may mesh with the case 102 and move in relation to the case 102 in a number of ways. For example, as shown in FIG. 1, cutting assembly 110 is attached to a pivot point 112. This attachment may be as simple as having a hole in the cutting assembly 110 for the pivot point 112 to pass through, or it may be done with any other suitable means that allows the cutting assembly 110 to pivot as required for cutting a candle. The pivot point 112 is also attached to the case, either directly or indirectly. For example, the pivot point 112 may be a separate piece that is glued, screwed, riveted, or attached by any other suitable means. The pivot point 112 could also formed in the same mold as the case 102. The pivot point may be preferably located towards one end of the cutting assembly, although one skilled in the art will recognize other suitable locations. This configuration allows the pivot point 112 to be functional to allow the cutting assembly 110 to move pivotally about the pivot point 112. As the cutting assembly 110 pivots about the pivot point 112, the cutting assembly may cut a candle within the inner cavity 108 of the candle cutter 100.

As one skilled in the art will appreciate, a cutting assembly may move (in relation to a case) by many other various means to perform the desired action of cutting a candle. For example, as shown in FIG. 4, one embodiment of the candle cutter 400 has a cutting assembly 406 meshing with the case by moving in a cutting direction that is longitudinal, as illustrated with the arrows. As the cutting assembly 406 longitudinally moves, it may pass through the outer surface slots (not shown in this figure) and the inner surface slots (not shown in this figure), thereby allowing it to cut a candle.

As described thus far, one skilled in the art may recognize that the cutting assembly may move laterally. While some lateral movement could be desired if a sawing cutting action is desired, too much lateral movement could cause one end of the cutting assembly 406 to pass through the outer surface slots, which would not be desirable when cutting a candle. Thus, some embodiments may limit the lateral movement such that the cutting assembly 406 cannot be laterally removed from the case without further action. If such lateral movement is not limited, for example, the cutting assembly may shift laterally when a user is attempting to cut a candle.

As one skilled in the art will readily appreciate, there are a number of different embodiments of the present apparatus that may limit such lateral movement. In one such embodiment, for example, the cutting assembly may contain handles or knobs, such as first knob 408 on a first end of the cutting assembly 406 and second knob 410 on a second end of the cutting assembly 406, that are wider than the outer surface slots (not shown in this view of the embodiment) such that the knobs 408, 410 will not pass through the outer surface slots, thereby limiting lateral movement. Handles, or knobs, 408 and 410 may be molded as part of the cutting assembly 406, or handles or knobs 408 and 410 may be made of any other suitable material. One or more of these handles or knobs 408 or 410 may be removable in an embodiment where one wishes to have the cutting assembly 406 removable. In such an embodiment, a user may remove one or both handles or knobs 408 and/or 410 and then laterally slide the cutting assembly 406 through the inner and outer surface slots (not shown in this figure but similar to the inner and outer surface slots shown in other figures) to remove the cutting assembly 406. Alternatively, the handles or knobs 408, 410 may be permanently attached such that a user is not able to remove the cutting assembly from the case.

As one skilled in the art may also appreciate, other embodiments may have other guide means such that a cutting assembly may pass through the inner and outer surface slots while limiting lateral movement. As shown in FIG. 5, for example, the candle cutter 500 may have one or more guide rods 508, 510. These guide rods 508, 510 may be attached to the case 512 or any other suitable part of the candle cutter 500. The attachment may be permanent or removable and may be by any suitable means, such as by screws, glue or other adhesive, bolts, rivets, or any other suitable means known to one of ordinary skill in the art. The guide rods 508, 510 may even be molded or otherwise created out of the same material and during the same process of creating the case 512. In this particular assembly, as an example, the cutting assembly 514 may contain one or more guide holes 516, 518 that allow the cutting assembly 514 to slidably interact with the guide rods 508, 510, thereby limiting lateral movement. In yet another embodiment, the cutting assembly may have any other suitable mechanism or approach instead of guide holes that may allow the cutting assembly to slidably interact with the guide rods, as one skilled in the art will readily recognize and appreciate.

As one skilled in the art will appreciate, a cutting assembly, such as cutting assembly 110 depicted in FIG. 1, cutting assembly 406 shown in FIG. 4, or cutting assembly 514 shown in FIG. 5, may include any number of elements required to perform the desired function of cutting a candle or similar item. For example the assembly may contain only a blade, such as blade 114 in FIG. 1 (although this cutting assembly also contains a handle formed by inner handle 138 and outer handle 140) or blade 412 in FIG. 4 (also containing handles or knobs 408, 410).

Another example of a blade assembly is shown in FIG. 5. In this example embodiment, the cutting assembly 514 contains a blade holder 520 to which one can attach a blade 522. Any number of variations is possible: For example, the blade 522 may be removable or detachable from the blade holder 520 while the blade holder 520 is more permanently attached; the blade holder 520 may be removable while the blade 522 is permanently attached to the blade holder 520; or the blade holder 520 may be removable or detachable while the blade 522 is also removable or detachable from the blade holder 520. In an embodiment where the blade 522 is removably attached to the blade holder 520, it may be attached by any suitable means known to one skilled in the art. For example, it may be attached by screws, nuts and bolts, or a release mechanism. In an embodiment where the blade 522 is more permanently attached to the blade holder 520, it may be attached, for example, by rivets, glue, permanent molding, or any other suitable means known to one skilled in the art.

It should also be understood that a blade for a cutting assembly may be any object suitable for cutting through a candle. For example, the blade may be similar to a common cutting device, such as a knife or razor blade. It may in fact be a razor blade. Alternatively, the blade may be made of a plastic. FIG. 6 shows yet another embodiment of a candle cutter 600 where the blade 604 may be a wire or string, such as fishing line, that can perform the desired function of cutting through a candle. In this particular embodiment, one end of the blade 604 may be attached to the case 606 or other part of the candle cutter 600 so as to prevent that end from moving. A user may then pull the other end of the blade 604 (or string, wire, or other suitable material) such that the blade 604 passes through the inner cavity 608, thereby cutting a candle or other similar object. In this particular embodiment, a user may desire to put a handle 610 on the blade 604. Although the handle 610 may take the form of a ring as shown in FIG. 6, the handle 610 may be in any other suitable shape, as recognized by one skilled in the art. It should also be recognized that candle cutter 600, similar to other embodiments, has inner surface slots 611, outer surface slots 612, an outer surface 614, and an inner surface 616.

As shown in FIG. 1, the candle cutter may further, but optionally, include at least one clamping mechanism 118, 120. The clamping mechanism, such as clamping mechanism 118 or 120, may be attached to the case. A user may use the clamping mechanism 118, 120 to hold the apparatus to a candle while cutting it. As one skilled in the art will appreciate, a clamping mechanism 118, 120 may help, for example, ensure that the candle cutter does not move in relation to the candle, which will help ensure that the candle is cut straight, i.e., there will be a lesser chance of a jagged cut. This clamping mechanism 118, 120 may be attached to the case, perhaps by a bracket and screw assembly such that the clamping mechanism 118, 120 may be screwed onto the case. Alternatively, as shown more clearly in FIG. 1 and FIG. 3, a clamping mechanism 118, 120 may pass through the outer surface and inner surface of the case such that it protrudes into the inner cavity. For example, the outer surface and inner surface may each contain a threaded hole (such as outer surface threaded holes 121, 122 and inner surface threaded holes 123, 124), whereby such threads interact with corresponding threads on the clamping mechanism, such as 125, 126, such that a user may turn the clamping mechanism to clamp the device to the candle. It is also possible that the clamping mechanism may only need to pass through either the outer surface 104 or the inner surface 106, depending upon the presence of such surfaces, which may be a matter of design choice. As shown in FIG. 4, for example, clamping mechanisms 416, 418 do not contain a plate similar to plates 129, 130.

As one skilled in the art will recognize, the clamping mechanism 118, 120 may contain any additional features that may help achieve the desired function. For example, the clamping mechanism 118, 120 may contain a knob 127, 128, shown as a wing nut in FIG. 1. As yet another example, the clamping mechanism that interfaces with a candle may contain a plate 129, 130 that may provide a larger surface area than the shaft of the clamping mechanism, thereby helping to prevent damage to a candle during the cutting process. The plate 129, 130, as well as the case's inner surface, may even contain padding (not shown) or other features that also help prevent undesired damage to a candle.

Figure 3:
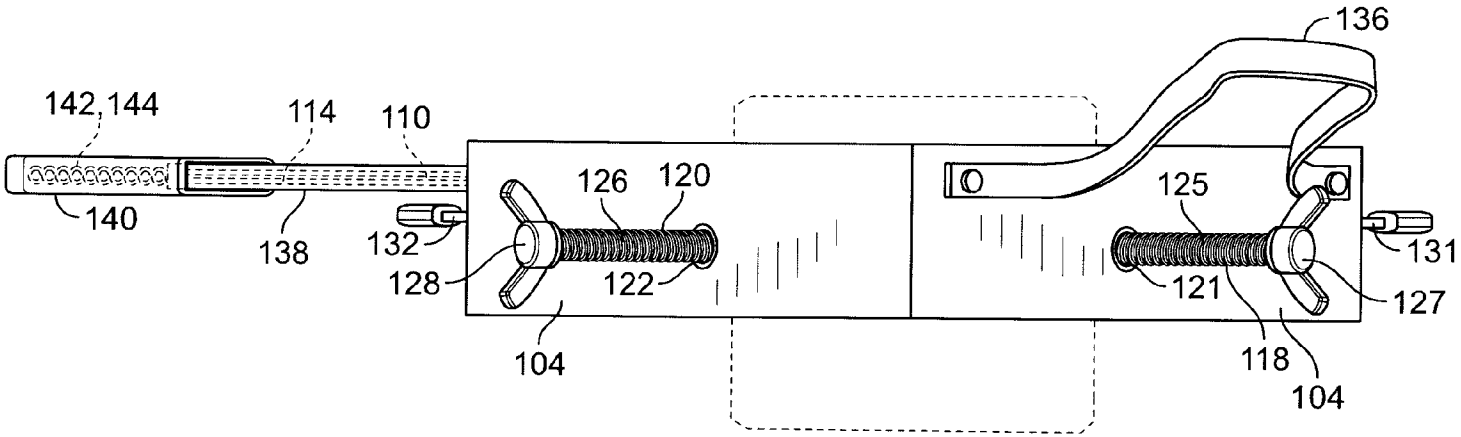
FIG. 3 shows a top and left view of the embodiment of the candle cutter shown in FIG. 1.

Yet another embodiment of a candle cutter may include a locking mechanism, shown as 131, 132 in FIG. 1, that may limit the cutting assembly 110 from moving when such movement is not desired, such as when the candle cutter 100 is not in use. If, for example, a person places the candle cutter 100 into a bag for travel and then reaches into the bag to retrieve the candle cutter 100, the person may cut him or herself if the blade longitudinally moves and then rests in a potentially dangerous position. As such, a user may wish to lock the cutting assembly 110 such that the blade is covered by the case, thereby preventing an accidental injury. Any suitable locking mechanism as recognized by one skilled in the art may be used. For example, locking mechanisms 131, 132 shown in FIG. 1 may include a locking mechanism slot 133, 134 in the outer surface 104 so as to allow a locking mechanism 131, 132 to limit, although perhaps not fully prevent, longitudinal movement of the cutting assembly 110. As illustrated in FIGS. 1 and 3, the locking mechanism may be moved in a position such that the locking mechanism 131, 132 limits longitudinal movement of the cutting assembly 110. In an embodiment such as that shown in FIG. 1, a locking mechanism may limit or prevent pivotal movement of the cutting assembly. In other embodiments, a locking mechanism may limit or prevent longitudinal movement.

FIG. 5 shows another possible embodiment of a locking mechanism 524, which may include a locking pin 526 that passes through the outer surface of the case 512. Furthermore, it may include a pin receiving member 528 attached to the cutting assembly 514, which will allow the locking pin 526 to interact with the pin receiving member 528 to limit longitudinal movement of the cutting assembly 514 in relation to the case 512. As one skilled in the art will appreciate, however, there are many other suitable means for achieving the same desired effect.

The candle cutter 100 of FIG. 1 may still include additional features that some users find desirable but may not be required for the basic function of the candle cutter. For example, a candle cutter may contain a case handle, such as case handle 136 in FIG. 1, case handle 414 in FIG. 4, or case handle 530 in FIG. 5, which may be attached to a case, perhaps permanently or detachably. A case handle 136, 414, or 530 may be attached by any suitable means as understood by one skilled in the art. For example, it may be attached by screws, rivets, bolts, or glue or other adhesive. It may even be molded as an inseparable part of the case.

Yet another feature may include a bottom container, such as bottom container 618 shown in FIG. 6, mounted to the case for the purpose of collecting candle wax. This bottom container 618 may be permanently or detachably mounted to the case 606, or as with other aspects of the candle cutter 600, it may be combined with other parts of the device. For example, the bottom container 618 may be molded as an extension of the case. Alternatively, the bottom container 618 may be detachably attached, perhaps by screws, a threaded interaction with the case, a clip, a clamp, or any other suitable means known to one of ordinary skill in the art. As one skilled in the art and users will appreciate, a bottom container 618 as described may collect candle wax, thereby making it easier for a user to clean up after cutting a candle.

Still another feature of a candle cutter 100 is shown as handle (formed by inner handle 138 and outer handle 140). While a handle (formed by inner handle 138 and outer handle 140) may be simply mounted to a cutting assembly 110, one skilled in the art will recognize the usefulness of other handle designs. With a pivoting cutting assembly that does not include a blade holder, for example, i.e., the blade alone makes up the cutting assembly, the blade could be exposed between the handle (formed by inner handle 138 and outer handle 140) and case 102 if, for example, the case 102 is square, as shown in FIG. 1. This is because, as readily recognized, the blade must be long enough to allow it to pivot. As such, one example of a more useful handle design is illustrated in FIG. 1. The handle 110 contains an inner handle 138, and one or more handle springs 142, 144. As shown in FIG. 1, handle springs 142, 144 are within the external handle 140 and attached to the internal end of the outer handle 140. The other end of the handle springs 142, 144 may be attached to the inner handle 138. The cutting assembly 110 may then be attached to the outer handle 140. In this configuration, handle springs 142, 144 may compress as inner handle 138 may telescopically slide into outer handle 140 as required as the cutting assembly 110 pivots. Other similar configurations will be recognized by one skilled in the art that achieve the same desired effect.

The above detailed description of a candle cutter and the examples described herein have been presented for the purposes of illustration and description and other variations will be recognized by those in the art. Furthermore, it should be recognized that many of the features of some illustrated embodiments could similarly be included or adapted for other illustrated embodiments. For example, in FIG. 4, case 420, having outer surface 422, may have locking mechanisms 424 and 426, which could be similar to locking mechanisms 131, 132 (as shown) or to locking mechanism 524. As yet another example, candle cutter 500 may also include clamping mechanism 532, as shown, which may be similar to clamping mechanism 118, 120, 416, or 418. Similar clamping mechanisms could also be present in FIG. 6 (not shown). Other embodiments may include even additional features that one skilled in the art will further appreciate. For example, another embodiment may include a protective/protecting case in which a user may place a candle cutter. Such a case may be a relatively soft bag or pouch or a hard case (perhaps made of plastic or metal). This case may further include a safety locking mechanism so as to protect a child or other user from gaining access to a candle cutter, which could be potentially dangerous with a sharp blade. As yet another example, one skilled in the art would appreciate that parts of a candle cutter may be driven by motors or other innovation so that a user does not have to do as much work to cut the candle.

It is therefore contemplated that the present invention cover any and all modifications, variations or equivalents that fall within the spirit and scope of the basic underlying principles disclosed above and claimed herein.

What is claimed is:

1. A candle cutter comprising:

a case having an outer surface and forming an inner surface defining an inner cavity;

said outer surface having one or more horizontal outer surface slots and said inner surface having one or more horizontal inner surface slots;

a clamping mechanism attached to said case operable to clamp a candle to be cut within said inner cavity;

a cutting assembly meshing with said case and having an inner handle and an outer handle, whereby said cutting assembly can move such that said cutting assembly passes through said one or more outer surface slots and passes through said one or more inner surface slots, thereby passing through said inner cavity horizontally for the purpose of cutting said candle to be cut therein;

a pivot point attached to said cutting assembly and said case;

wherein said pivot point is functional to allow said cutting assembly to be pivotally rotatable;

handle springs positioned between said inner handle and said outer handle that compresses as said inner handle telescopically slides into said outer handle when the cutting assembly pivots; and a locking mechanism for limiting pivotal movement of the cutting assembly when not in use.

2. The candle cutter of claim 1, wherein said clamping mechanism is attached to said case by passing through said one or more outer surface slots and said one or more inner surface slots, thereby protruding into said inner cavity.

3. The candle cutter of claim 1, further comprising a case handle attached to said case.

4. The candle cutter of claim 1 wherein said cutting assembly contains a detachable blade.

* * * * *